US006688222B2

(12) United States Patent
Cattaruzza et al.

(10) Patent No.: US 6,688,222 B2
(45) Date of Patent: Feb. 10, 2004

(54) MULTIPLE-COLOR FLEXOGRAPHIC ROTARY PRINTING MACHINE

(75) Inventors: Mauro Cattaruzza, Malo (IT); Agostino Pertile, S. Martino Buon Albergo (IT)

(73) Assignee: Uteco Holding S.p.A., Colognola ai Colli (IT)

( * ) Notice: Subject to any disclaimer, the term of this patent is extended or adjusted under 35 U.S.C. 154(b) by 0 days.

(21) Appl. No.: 09/958,829

(22) PCT Filed: Feb. 14, 2001

(86) PCT No.: PCT/EP01/01604

§ 371 (c)(1),
(2), (4) Date: Oct. 15, 2001

(87) PCT Pub. No.: WO01/60617

PCT Pub. Date: Aug. 23, 2001

(65) Prior Publication Data

US 2002/0157547 A1 Oct. 31, 2002

(30) Foreign Application Priority Data

Feb. 18, 2000 (IT) ..... VR2000A0013

(51) Int. Cl.[7] ..... B41F 5/18; B41F 7/10
(52) U.S. Cl. ..... 101/212; 101/174; 101/183
(58) Field of Search ..... 101/212, 171, 101/174, 180, 181, 183, DIG. 41

(56) References Cited

U.S. PATENT DOCUMENTS

| | | | | | |
|---|---|---|---|---|---|
| 4,397,664 | A | * | 8/1983 | Kramers | 62/183 |
| 4,966,352 | A | * | 10/1990 | Nuttin | 270/1.01 |
| 5,582,569 | A | * | 12/1996 | Kowalewski et al. | 493/52 |
| 5,953,991 | A | * | 9/1999 | Geissenberger et al. | 101/218 |
| 6,293,192 | B1 | * | 9/2001 | Bartlett | 101/212 |

FOREIGN PATENT DOCUMENTS

| | | |
|---|---|---|
| DE | A-195 27 199 | 1/1997 |
| EP | A-0 669 208 | 8/1995 |

* cited by examiner

*Primary Examiner*—Dan Colilla
*Assistant Examiner*—Jill E Culler
(74) *Attorney, Agent, or Firm*—Guido Modiano; Albert Josif; Daniel O'Byrne

(57) ABSTRACT

A rotary printing machine comprising two supporting shoulders, a central drum or cylinder being rotatably mounted on the supporting shoulders, at least one printing unit being arranged around the drum and comprising a printing plate cylinder and an anilox roller, which are rotatably mounted on a respective pair of supporting elements and whose rotation axis is parallel to the axis of the drum, wherein at least the central drum is actuated by a source of motion which directly engages an axial shank of the drum.

21 Claims, 5 Drawing Sheets

MULTIPLE-COLOR FLEXOGRAPHIC ROTARY PRINTING MACHINE

BACKGROUND OF THE INVENTION

The present invention relates to a multiple-color flexographic rotary printing machine.

In a flexographic printing process, colored ink is applied to a printing medium by means of three printing rollers or cylinders which rotate synchronously and in contact, with parallel rotation axes.

The three printing rollers comprise an impression roller, designed to support the material to be printed, a printing plate cylinder, which supports the pattern to be printed (printing plate), and an anilox or inking roller which applies ink to the printing plate. Printing occurs when the ink is deposited by the printing plate onto the medium, in an amount and in a manner which depend on the characteristics of the printing plate and of the anilox roller.

The color station is constituted by all the systems that move the three rollers, the ink and the material for printing a single color.

In current printing machines, the rotary motion of the three printing rollers is obtained by way of a mechanical transmission of the motion from a single electric motor; the electric motor transmits the motion by means of a reduction stage to the impression roller, which in turn transmits the motion to the printing plate cylinder by way of two gears which are axially aligned with the respective rollers and mesh together. A similar transmission system is adopted between the printing plate cylinder and the anilox roller.

In so-called "central-drum" printing machines, the impression roller is a single roller (central drum) for all the color stations and so is the ring gear that transmits the movement to the gears in axial alignment with the respective printing plate cylinders; the toothed ring has a peripheral diameter being equal to the diameter of the drum.

In order to eliminate the problems of gear-based transmission, systems have recently been studied and produced in which each printing roller is driven by its own electric motor, thus eliminating the mechanical connection of the gears between the printing rollers.

All the currently provided solutions are characterized by one or more transmission couplings and/or a motion reduction stage between the motor and the respective printing roller (the motion reduction stage designed to bring the rotation rate of the motor down to the rotation rate that corresponds to the speeds that the rollers must have for a correct printing process).

The reduction stage is generally constituted by a reduction unit or by gears being combined with a belt drive.

These technical solutions, which have transmission couplings and/or a motion reduction stage, have several disadvantages, the main ones being:

- the play of the gears of the reduction stage (by means of reduction units or a belt) sets a limit to the precision of the printing registration of the colors;
- the limited mechanical rigidity of a transmission system with transmission couplings and/or a reduction stage can cause vibration at low frequencies and can therefore facilitate the onset of resonance;
- the manufacturing systems are mechanically complicated, wear easily and are also particularly expensive;
- the transmission, in particular, is complicated and bulky, requires long assembly times and entails the use of precision mechanical components, which are expensive and delicate and require frequent maintenance.

SUMMARY OF THE INVENTION

The aim of the present invention is to eliminate or substantially reduce the above noted drawbacks, by providing a rotary printing machine with a central drum in which motion is provided to the central drum and to the printing plate cylinders without transmission couplings and/or motion reduction stages.

An object of the present invention is to provide a rotary printing machine which ensures a substantial increase in the torsional and flexural mechanical rigidity of the rotation shaft.

Another object of the present invention is to provide a rotary printing machine which raises the resonance frequency of the printing system.

Another object of the present invention is to provide a rotary printing machine which allows greater precision in printing registration, a structural simplification and a reduction in the mechanical parts that are subject to wear, so as to increase its reliability and at the same time reduce operating and maintenance costs, making them significantly more favorable than those of a conventional printing machine.

This aim and these and other objects which will become better apparent hereinafter are achieved by a rotary printing machine comprising two supporting shoulders, a central drum or cylinder being rotatably mounted on said supporting shoulders, at least one printing unit being arranged around said drum and comprising a printing plate cylinder and an anilox roller, which are rotatably mounted on a respective pair of supporting elements and whose rotation axis is parallel to the axis of said drum, characterized in that at least said central drum is actuated by a source of motion which directly engages an axial shank of said drum.

Conveniently, the source of motion for the drum has a stator being rigidly fixed to one of said supporting shoulders and a rotor being rigidly fixed at the end of an axial shank of the drum.

Advantageously, the rotary printing machine comprises a source of motion for the or each printing plate cylinder and for the or each anilox roller.

Conveniently, said source of motion for the or each printing plate cylinder comprises an electric motor in which the stator is rigidly fixed to one of said supporting elements and is monolithic therewith, and a rotor which is rigidly fixed to a motor shaft being coaxial to the respective printing plate cylinder and being slideable transversely to said stator and rigidly with the respective printing plate cylinder.

BRIEF DESCRIPTION OF THE DRAWINGS

Further features and advantages of the present invention will become better apparent from the following detailed description of a preferred embodiment thereof, given by way of non-limitative example with reference to the accompanying drawings, wherein.

DESCRIPTION OF THE PREFERRED EMBODIMENTS

With reference to the drawings, a multiple-color flexographic rotary machine 1 provided with a central drum 2, according to the present invention, is constituted by two supporting shoulders 3 and 4, on which the drum 2 is rotatably mounted, and by an electric motor 5 for the actuation of the drum 2.

Figure 2:
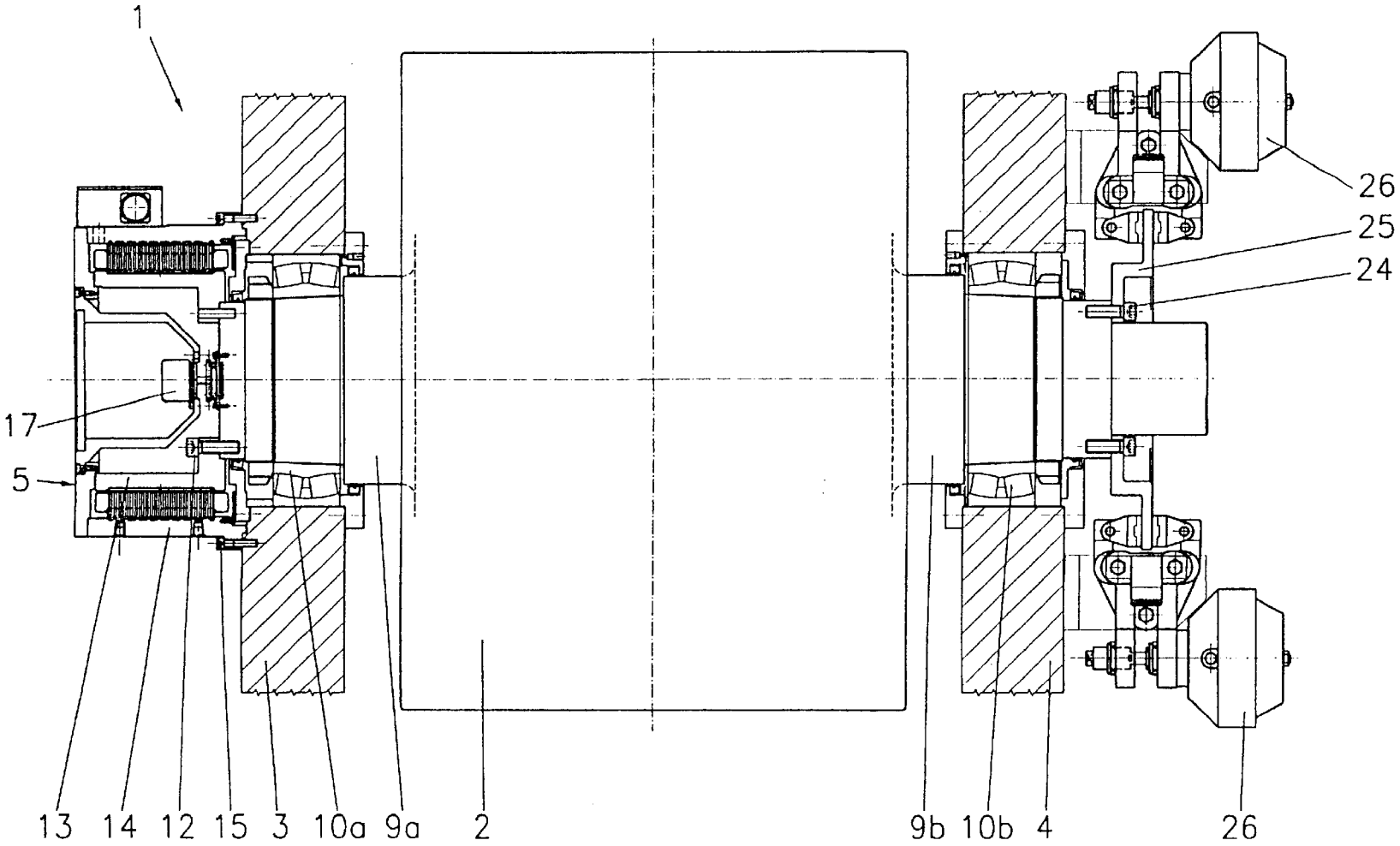
FIG. 2 is an enlarged-scale schematic top view of the central drum, with some parts shown in cross-section, of the flexographic machine of FIG. 1.
Figure 3:
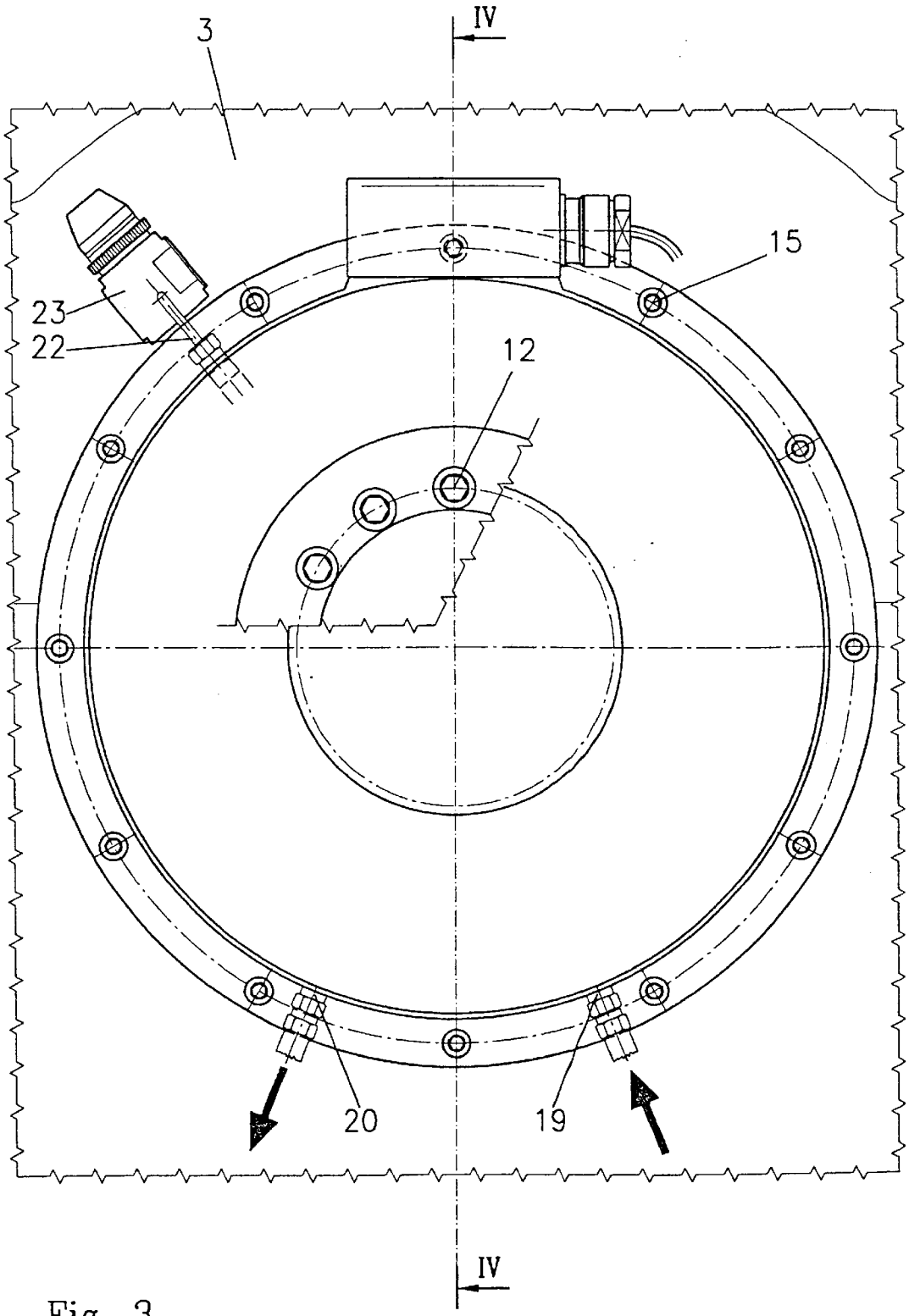
FIG. 3 is a schematic and partial side view of the motor of the central drum of FIG. 2.

As shown in FIG. 2, the drum 2 has an axial shank (front part 9*a* and rear part 9*b*), which is rotatably supported by the shoulders 3 and 4, for example by means of adjustable roller bearings, designated by the reference numerals 10*a* and 10*b* respectively. Preferably, the outer part 9*a* of the shank is cropped just after the respective shoulder 3. An inwardly flanged end of the rotor 13 of the electric motor 5 is bolted at the end of the shank 9*a* (by means of bolts 12); the stator 14 of the motor is flanged externally and bolted, by means of bolts 15, to the outer face of the shoulder 3.

In this manner, the shank 9*a,* and therefore the drum 2, is directly coupled to the electric motor 5, which in turn is directly axially connected to the drum 2. The bearings 10*a* and 10*b* in fact, besides supporting the weight of the central drum 2, ensure a perfectly coaxial arrangement of an annular rotor 13 and of a stator 14 of the motor 5. Accordingly, the drum 2 does not need to have a ring gear for its rotary actuation.

Multiple printing units 11 (eight in the example shown in FIG. 1) are provided around the central drum 2, and each one (usually comprising a printing plate cylinder 30 and an anilox roller 8) has its own source of motion. This means that in addition to a servomotor (i.e., the motor 5) for the central drum 2, there are eight servomotors 6 for the printing plate cylinders 30 and eight servomotors 7 for the anilox rollers 8; all the servomotors are driven by means of an electronic controller 16 (shown in FIG. 1).

More particularly, on the shank 9*a* (or 9*b*) there is a transducer 17, for example an encoder, which is mounted coaxially to the shank 9*a* inside the annular rotor 13, as shown in FIG. 2, and is designed to transmit to the controller 16 data related to the rotation rate of the central drum 2 in order to control the operation of the electric motor 5 of said drum and synchronize it with the electric motors 6 and 7 of each printing unit 11.

Figure 4:
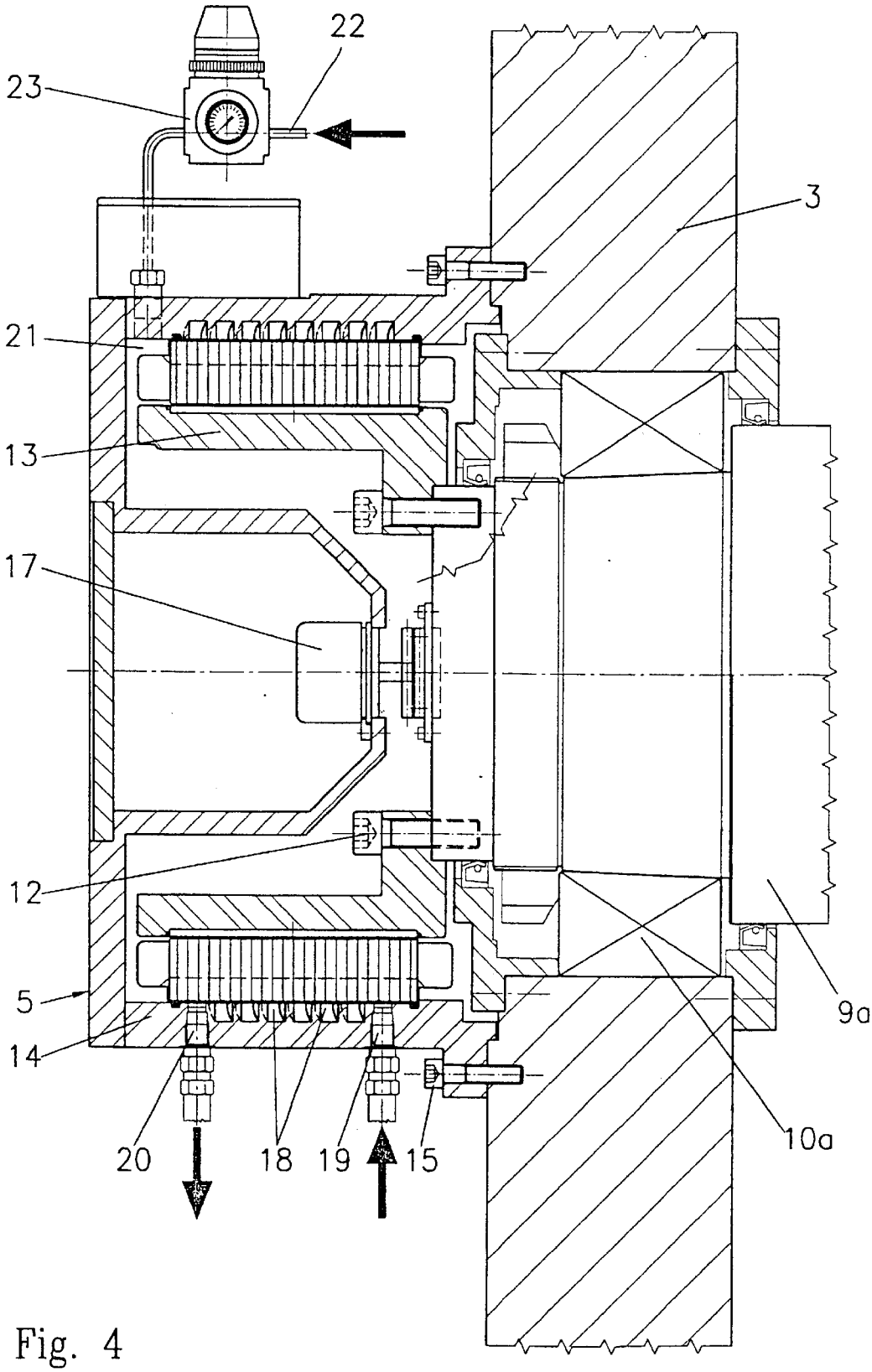
FIG. 4 is a partial sectional view, taken along the line IV—IV of FIG. 3.

Preferably, the electric motor 5 is cooled by way of a cooling system of any suitable type, for example with water fed by an appropriately provided pump (not shown in the drawings) and designed to flow through a labyrinth, represented schematically by a system of channels 18 arranged around the stator 14 starting from an inlet 19 up to an outlet 20, as shown in FIG. 4.

In order to prevent dust, which in the long run might compromise the correct operation of the motor 5, from entering said motor 5, there is a pressurization system formed by channels 21 between the stator 14 and the rotor 13 which are connected to an inlet 22 for slightly pressurized air which originates from a blower, not shown and being of any suitable type, through a pressure reduction unit 23.

Figure 1:
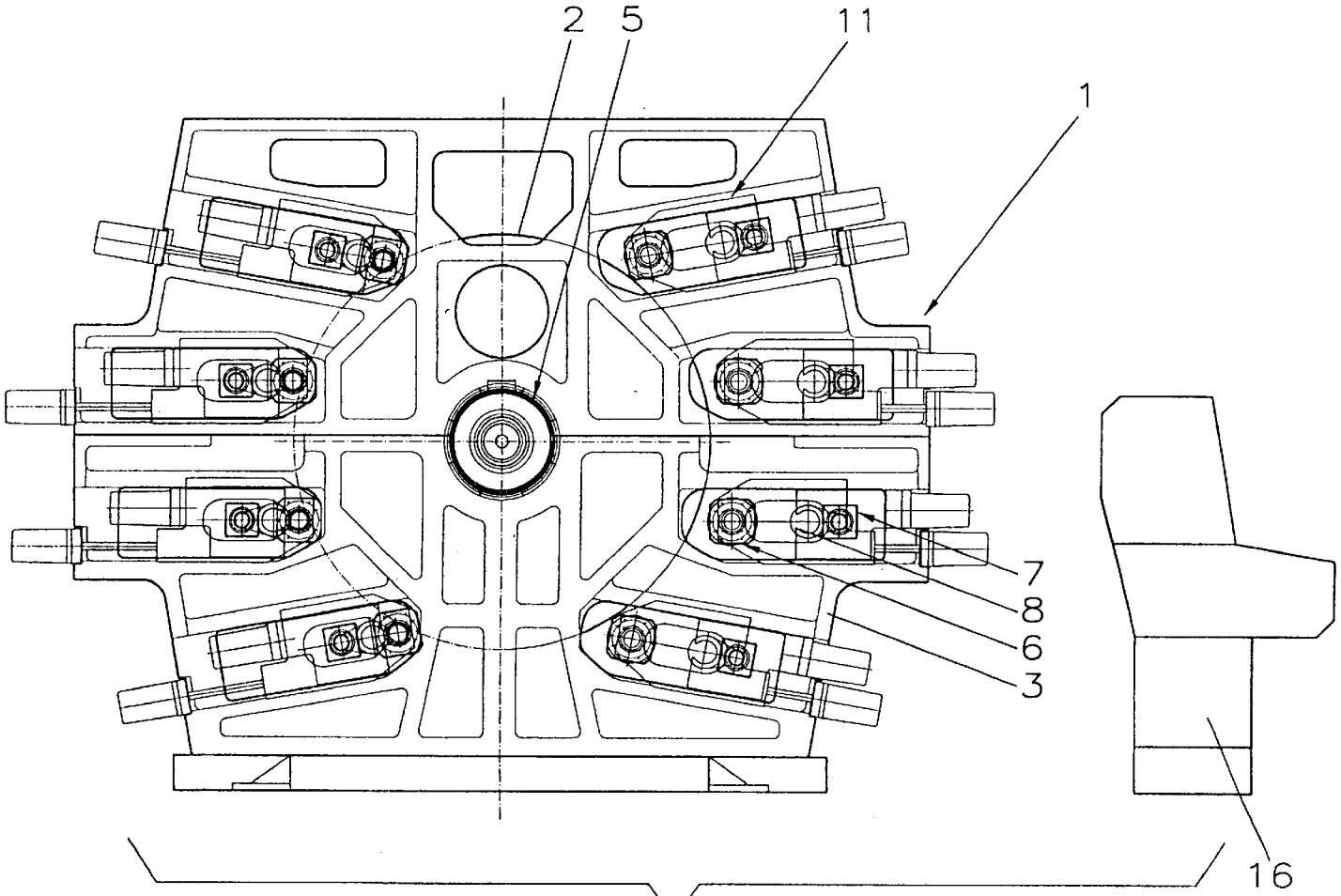
FIG. 1 is a schematic side elevation view of a central-drum flexographic machine according to the present invention.

A disc 25 is fixed, for example bolted by means of bolts 24, on the other side of the drum 2, i.e., on the shank 9*b* (FIG. 2); one or more caliper brakes 26 can act on the disc and are driven by the controller 16 of FIG. 1 in order to control the deceleration of the drum 2 during emergency braking and keep the drum 2 locked in a precise angular position when necessary.

Figure 5:
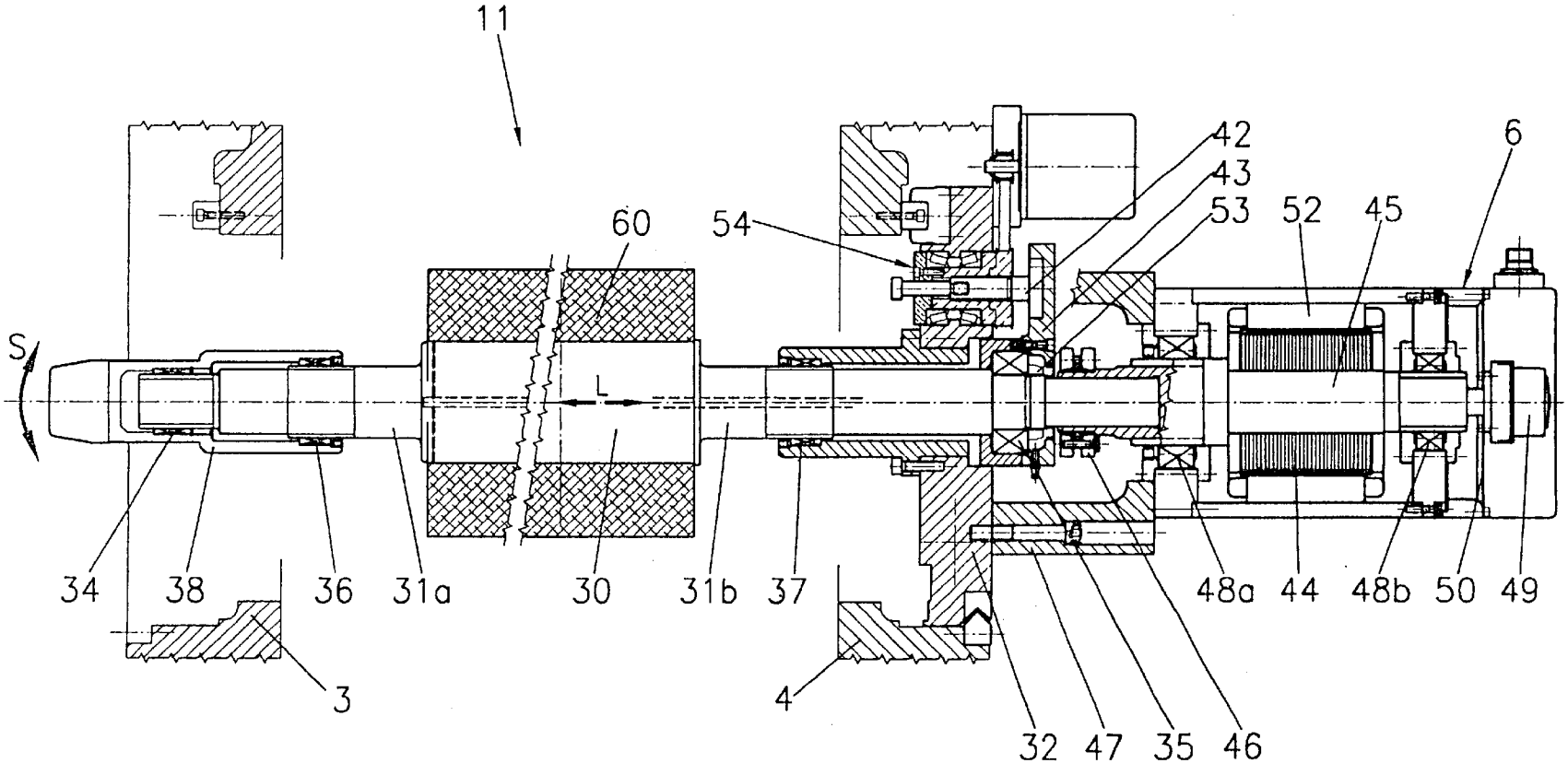
FIG. 5 is a sectional view, taken along a longitudinal plane, of a color unit of the machine of FIG. 1.

As regards the motor drive of the printing plate cylinder 30 and the support and rotation system, FIG. 5 illustrates a currently preferred example of embodiment.

The printing plate cylinder 30 has a front shank 31*a* being supported by two bearings 34 and 36 which are necessary in order to give flexural rigidity to the cylinder.

The bearings 34 and 36 can be inserted in a sleeve 38 which allows the axial sliding of the printing plate cylinder 30 (arrow L) in order to allow the movement, for example by +/−6 mm, required for transverse registration of the print.

Again in order to increase the flexural rigidity of the printing plate cylinder 30, the cylinder has a rear shank 31*b* which is supported by the supporting shoulder 4 by way of two bearings: the roller bearing 37 and the double ball bearing 35. Moreover, the bearing 37 is arranged as close as possible to the sleeve or printing plate 60 in order to limit the deflection related to the flexural deformation of the roller 30 and limit the hunting oscillations (as shown by the arrow S in FIG. 5) during the operations for changing the sleeve 60.

The rear shank 31*b* of the printing plate cylinder 30 is further keyed to an electric motor 6 whose partially hollow shaft 45 is locked on the rear shank 31*b* by way of a conical keying element 46.

Advantageously, the outer or stator part 52 of the electric motor 6 is rigidly flanged to the slider 32 by means of a cast-iron support 47 and is thus rigidly coupled to the slider 32. The rotor 44 is fixed to the motor shaft 45, being supported by two roller bearings 48*a* and 48*b* which allow the axial sliding, for example by +/−6 mm, of the motor shaft 45 and therefore of the rotor 44. The bearings 48*a* and 48*b* withstand very well the radial loads generated by the flexing of the printing plate cylinder 30, ensuring high flexural rigidity.

The system for joining together the printing plate cylinder 30 and the electric motor 6 is preferably provided by the insertion of the rear shank 31*b* inside the partially hollow end of the motor shaft 45. There is also a conical keying element 46 for rigidly closing the rear shank 31*b* on the motor shaft 45; this coupling system ensures the transmission of very high moments and perfect mating between the shank 31*b* and the motor shaft 45.

In practice, the above described system for supporting and mechanically connecting the printing plate cylinders 30, the motor shaft 45, the rotor 44 and the stator 52 ensures a mechanical rigidity which is greatly increased with respect to the solutions currently used to motorize the printing plate cylinders 30. In particular, the body constituted by the rigid coupling between the printing plate cylinder 30, the motor shaft 45 and the rotor 44 combines very high flexural and torsional rigidity with the ability to perform a translation movement along the rotation axis to the extent required for transversely registering the print.

An encoder 49 or other suitable transducer system is fixed to the stator 52 of the motor 6 by means of a coupling 50 which is torsionally very rigid but axially very flexible in order to allow the movement of transverse registration by +/−6 mm.

The axial coupling for transverse registration is provided by means of a double ball bearing 35, whose inner ring (not shown in the figures) is locked by means of an annular element 53 approximately halfway along the rear shank 31*b,* while the outer ring (not shown in the figures) is rigidly coupled to an oval flange 43 to which the trapezoidal screw 42 is fixed in the upper part; said screw, turned by the transverse registration device 54, generates the axial movement of the printing plate cylinder 30.

With a rotary or flexographic printing machine structured as described above, a substantial simplification of the mechanical components with respect to conventional-type machines is achieved. In particular, the direct coupling between each source of motion (electric motors 5 and 6) and, respectively, the central drum 2 and the printing plate cylinders 30 allows to achieve high mechanical rigidity, accordingly achieving a considerable increase in the value of the resonance frequency of the motor-cylinder-supporting structure system, so as to be able to increase the speed of response to the dynamics of said system so as to maintain an unchanged (constant) print quality.

The above described invention is susceptible of numerous modifications and variations within the protective scope defined by the content of the appended claims.

The materials and the dimensions may be various according to requirements.

The disclosures in Italian Patent Application No. VR2000A000013 from which this application claims priority are incorporated herein by reference.

What is claimed is:

1. A rotary printing machine comprising two supporting shoulders, a central drum or cylinder being rotatably mounted on said supporting shoulders, at least one printing unit being arranged around said drum and comprising a printing plate cylinder and an anilox roller, which are rotatably mounted on a respective pair of supporting elements and whose rotation axis is parallel to the axis of said drum, at least said central drum being actuated by a source of motion which directly engages an axial shank of said drum, said source of motion of said central drum comprising an electric motor in which the stator is fixed to one of said supporting shoulders and the respective rotor can rotate inside said stator and is rigidly fixed to said axial shank of said central drum, said rotor having a flanged end which is rigidly fixed to an end of said axial shank.

2. The machine according to claim 1, wherein said electric motor of said central drum comprises a forced-fluid cooling system.

3. The machine according to claim 2, wherein said cooling system comprises a pump and a labyrinth circuit arranged around said stator of said electric motor for the passage of the fluid supplied by said pump.

4. The machine according to claim 1, wherein said electric motor comprises a pressurization system comprising a plurality of channels between said stator and said rotor, a source of compressed air which is connected to said channels, and a device for controlling the pressure of the air that arrives from said source and said channels.

5. The machine according to claim 1, comprising a source of motion for the or each printing plate cylinder and for the or each anilox roller.

6. The machine according to claim 5, wherein said source of motion for the or each printing plate cylinder comprises an electric motor in which the stator is rigidly fixed to one of said supporting elements and is monolithic therewith and the rotor is rigidly fixed to a motor shaft which is coaxial to the respective printing plate cylinder.

7. The machine according to claim 6, wherein said rotor can slide transversely to said stator together with the respective printing plate cylinder.

8. The machine according to claim 6, further comprising at least one pair of bearings suitable to rotatably support said motor shaft and to allow an axial sliding of said motor shaft.

9. The machine according to claim 8, wherein said bearings are of the roller type.

10. The machine according to claim 6, wherein said motor shaft has a hollow end which can be keyed onto an axial shank of the respective printing plate cylinder.

11. The machine according to claim 10, further comprising locking means suitable to ensure the fixing of said axial shank of the or each printing plate cylinder inserted, during use, in said hollow end of the respective motor shaft.

12. The machine according to claim 11, comprising means for coupling the or each printing plate cylinder to the respective supporting elements, which are suitable to allow the rotation and axial sliding of the or each printing plate cylinder in relation to the respective supporting elements.

13. The machine according to claim 12, wherein said coupling means comprise at least one pair of internal bearings which are arranged proximate to the sleeve mounted on the or each printing plate cylinder, so as to limit the deflection related to the flexural deformation of each printing plate cylinder and the hunting oscillations during operations for replacing said sleeve and at least one pair of external bearings.

14. The machine according to claim 11, comprising at least one movable support for said axial shank of the or each printing plate cylinder, retained so as to perform transverse strokes with respect to said rotation axis of the respective printing plate cylinder in order to allow transverse printing registration.

15. The machine according to claim 1, wherein said flanged end of said rotor is rigidly fixed to said end of said axial shank by means of axially extending bolts.

16. The machine according to claim 1, wherein said axial shank of said central drum is rotatably mounted on said one of said supporting shoulders for rotatably mounting said central drum on said supporting shoulders.

17. A rotary printing machine comprising two supporting shoulders, a central drum or cylinder being rotatably mounted on said supporting shoulders, at least one printing unit being arranged around said drum and comprising a printing plate cylinder and an anilox roller, which are rotatably mounted on a respective pair of supporting elements and whose rotation axis is parallel to the axis of said drum, at least said central drum being actuated by a source of motion which directly engages a first axial shank of said drum, said source of motion of said central drum comprising an electric motor in which the stator is fixed to one of said supporting shoulders and the respective rotor can rotate inside said stator and is rigidly fixed to said first axial shank of said central drum, said rotor having a flanged end which is rigidly fixed to an end of said first axial shank, the rotary printing machine further comprising a disc-type braking system which is keyed onto a second shank of said central drum and at least one caliper for engaging said disc on command, said first and second shanks being rotatably mounted on said supporting shoulders for rotatably mounting said central drum on said supporting shoulders.

18. The machine according to claim 17, comprising an electronic controller for driving at least said source of motion and said braking system of said central drum.

19. The machine according to claim 18, comprising at least one first transducer which is mounted so as to be axially aligned with said rotor of said electric motor of said central drum and is suitable to generate electric signals which represent the position and angular velocity of said rotor, and therefore of said central drum, and to send them to said electronic controller in order to drive and control the motion of said central drum.

20. The machine according to claim 18, comprising a second transducer which is mounted in axial alignment with said rotor of said electric motor of the or each printing plate cylinder, said transducer being suitable to generate electric signals which are representative of the position and angular velocity of said rotor and therefore of each printing plate cylinder and to send them to said electronic controller in order to drive and control the motion of each printing plate cylinder and synchronize it with the motion of said central drum and of the remaining printing plate cylinders and anilox rollers.

21. The machine according to claim 20, comprising a torsionally rigid and axially flexible coupling which is suitable to fax said transducer to said stator of said electric motor of the or each printing plate cylinder and allow the axial movement of said rotor to an extent which is at least sufficient for transverse print registration.

* * * * *